United States Patent [19]

Hoban

[11] Patent Number: 4,920,866

[45] Date of Patent: May 1, 1990

[54] ANTI BACK DRAFT DEVICE FOR FLUE

[76] Inventor: Michael Hoban, P.O. Box 188, Pinawa, Manitoba, Canada, R0E 1L0

[21] Appl. No.: 333,197

[22] Filed: Apr. 5, 1989

[30] Foreign Application Priority Data

May 12, 1988 [CA] Canada ..... 566591

[51] Int. Cl.[5] ..... F23L 17/16

[52] U.S. Cl. ..... 98/45; 98/47; 98/48; 110/160

[58] Field of Search ..... 98/45, 47, 48, 58, 60, 98/119; 110/160, 161; 126/312

[56] References Cited

U.S. PATENT DOCUMENTS

| | | | |
|---|---|---|---|
| 566,591 | 8/1896 | Lloyd . | |
| 1,604,271 | 10/1926 | Friedman | 110/160 |
| 1,689,241 | 10/1928 | Haber | 110/162 |
| 2,397,870 | 4/1946 | Kneass, Jr. | 110/160 X |
| 2,951,457 | 9/1960 | Kneass | 110/160 |
| 2,979,322 | 4/1961 | Dailey . | |
| 3,134,345 | 5/1964 | King | 110/160 |
| 3,175,552 | 3/1965 | Sutton . | |
| 3,527,177 | 9/1970 | LaRue | 110/160 X |
| 3,570,423 | 3/1971 | Hemmingson | 110/160 |
| 4,149,453 | 4/1979 | Reed | 98/46 |
| 4,262,608 | 4/1981 | Jackson | 110/162 |
| 4,285,325 | 8/1981 | Bellaff | 110/160 X |
| 4,424,792 | 1/1984 | Shimek et al. | 110/162 X |
| 4,487,137 | 12/1984 | Horvat | 110/160 |
| 4,512,264 | 4/1985 | Crawford | 110/160 |
| 4,768,444 | 9/1988 | De Werth et al. | 110/160 |

FOREIGN PATENT DOCUMENTS

| | | | |
|---|---|---|---|
| 197499 | 2/1920 | Canada . | |
| 198745 | 3/1920 | Canada . | |
| 198993 | 4/1920 | Canada . | |
| 201833 | 7/1920 | Canada . | |
| 317336 | 11/1931 | Canada . | |
| 345392 | 10/1934 | Canada . | |
| 487573 | 10/1952 | Canada . | |
| 514680 | 7/1955 | Canada . | |
| 60345 | 9/1982 | European Pat. Off. | 98/45 |
| 2101495 | 7/1972 | Fed. Rep. of Germany | 98/48 |

*Primary Examiner*—Harold Joyce

*Attorney, Agent, or Firm*—Adrian D. Battison; Stanley G. Ade; Murray E. Thrift

[57] ABSTRACT

Back draft is prevented in a conventional furnace or woodstove system in which the combustion gases are generally sufficient to generate the positive draft for combustion but occasionally fails due to pressure differences, combustion conditions or outside temperature conditions. The back draft device comprises a nozzle mounted in the flue which is connected to a duct supplying pressurized air from a fan which is passed over a heater so that heated air is injected into the flue. A flow control device comprises a housing which is divided by a transverse sheet. In a front face on one side of the divider is provided a flap valve controlling air inlet into the duct of the fan. On the other side of the divider is provided a flap valve controlling an air outlet from the outside of the building. The flow control device automatically controls whether the air for the nozzle is drawn from the interior or the exterior of the building depending upon the pressure differences. The device can be actuated by a temperature sensor in the flue.

15 Claims, 3 Drawing Sheets

ANTI BACK DRAFT DEVICE FOR FLUE

BACKGROUND OF THE INVENTION

This invention relates to a combustion device and flue and particularly to an improvement by which the possibility of back draft, that is the reversal of the normal flow of gases in the flue, is prevented or at least reduced.

Various combustion devices are available mounted within buildings in which the heated gases generated in the combustion are extracted from the building by a flue which extends from the combustion device to an outlet in the exterior of the building. In some cases the flue gases are assisted or driven in their movement by a fan arrangement or a flow induction arrangement. This technique is often used in cases where increased heat of combustion is required, in cases where the temperature of the flue gases is reduced by the extraction of heat to a level where they cannot themselves sustain the necessary convection current, or in cases where it is desired that the combustion device operate without a conventional flue stack which is of course necessary to generate the updraft. Examples of these devices are shown in U.S. Pat. Nos. 4,262,608 (Jackson), 4,512,264 (Crawford), 2,979,322 (Dailey), 3,134,345 (King), 2,951,457 (Kneass), 4,149,453 (Reed), 3,570,423 (Hemmingson), 3,527,177 (LaRue), 1,689,241 (Haber), and 4,24,792 (Shimek). In addition similar examples are shown in Canadian Pat. Nos. 487,573 (Campbell), 514,680 (Edwards), and 317,336 (Delamere).

Further patents use a device for assisting the flow through a flue by generating an air stream in the forward direction which induces increased draft. Examples of these devices are shown in U.S. Pat. No. 1,604,271 (Friedman) and 3,175,552 (Sutton). Friedman uses the device to increase combustion when required by a fan which injects air into the combustion chamber and part of that air is bypassed into the flue to increase the draft within the flue. Sutton provides a device which increases the air flow through the flue by an induction system in view of the fact that the normal combustion gas flow is inhibited by heat exchanger positioned in the fireplace.

Other patents relating to steam locomotives show various induction arrangements for improving the combustion. Examples are shown in Canadian Pat. Nos. 239,344, 384,749, 229,808, 216,732, 229,807.

The present invention is concerned with conventional furnaces or woodstoves which generally will when the combustion is operating at a reasonable level generate enough heat in the combustion gases that the flue including a flue stack will cause the updraft to draw the flue gases away from the combustion device.

Conventional chimneys are intended to conduct combustion gases and smoke particles out of the building. However, they can just as well provide a path for movement of air into the building if the air pressure inside is less than the pressure outside. Interior air pressure can become reduced relative to ambient pressure if air is exhausted by bathroom, kitchen and clothes dryer fans and building heating equipment faster than it can be replaced by infiltration of outside air. In such cases, "combustion-venting failure" occurs and smoke is drawn into the building rather than moving along the flue. This can affect health and even cause death due to poisoning by gases such as carbon monoxide or due to fire started when flames or embers are drawn into a room. The problem occurs most often when a fire is first lit or when it is dying because the small fire at that stage does not heat the flue enough or produce sufficient hot gases to overcome pressure differences.

When the flue and the flue gases cool sufficiently, particularly in cold outside temperatures, the convection effect on the vertical column of air in the flue can reverse, causing the movement of air in the flue to reverse in direction due to the fact that it is colder than the interior air of the building. This can cause an inflow of the cold air which may sweep the combustion materials from the combustion device into the building.

This problem is widely experienced particularly where the flue is exterior to the building and hence more susceptible to cooling due to the surrounding cold temperatures.

Despite the wide problem, little effective solution is available at the present time. Attention has been given to the problem of pressure equalization in that in many cases the household now provides an inlet for outside air to ensure that the pressure inside the building does not significantly fall below that of the outside ambient air pressure. However this by itself does not solve the problem since the cooling effect on the flue gases itself can generate the reverse flow or back draft.

The above prior art patents show various devices for inducing air flow in the flue but these generally operate continuously or are operated manually to improve or increase combustion temperatures.

SUMMARY OF THE INVENTION

It is one object of the present invention, therefore, to provide an improved combustion arrangement which prevents or inhibits the development of back draft in the combustion flue.

According to the present invention, therefore, there is provided a combustion and flue device comprising a combustion device mounted within the interior of a building, a flue leading from the combustion device and including at least a part thereof which rises to an outlet communicating with the exterior of the building at a height above the combustion device and arranged such that heat in the combustion gases generated by the combustion device is, at least part of the time, sufficient to generate a forward flow of the gases in the flue from the combustion device to the outlet, a nozzle in the flue arranged to inject gases into the flue in a forward direction to tend to induce flow of the gases in the flue in the forward direction, a duct communicating from an inlet means to the nozzle, fan means in the duct for generating a flow of gases from the inlet means to the nozzle, heating means in a duct for heating the gas as it travels from the inlet means to the nozzle, and means responsive to a back draft condition in the flue to actuate said fan means and said heating means.

The back draft hazard is therefore prevented by injecting heated air into the flue once the back draft condition is detected. This hot air is directed toward the outlet of the flue to achieve two effects:

1. Air is drawn through the stove or other heating unit and up the chimney as of a result of the induction effect of the nozzle to restore combustion.

2. The air in the vertical column of the flue is quickly reheated thus reversing the down flow carried by the convection currents and reverting to the proper upward convection flow in the flue.

With the foregoing in view, and other advantages as will become apparent to those skilled in the art to which this invention relates as this specification proceeds, the invention is herein described by reference to the accompanying drawings forming a part hereof, which includes description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
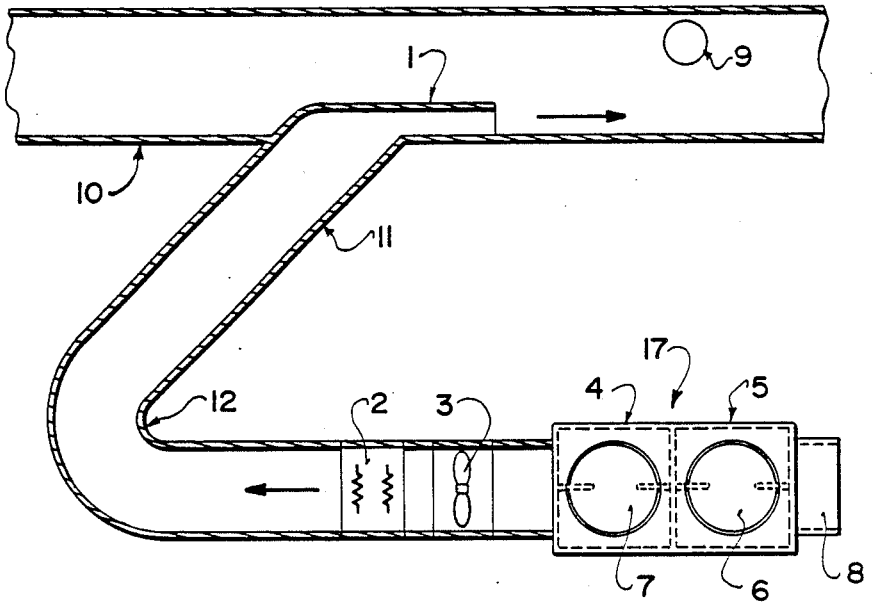
FIG. 1 is a schematic illustration partly in elevation and partly in cross-section of an attachment unit according to the invention for attachment to a conventional combustion system.
Figure 4:
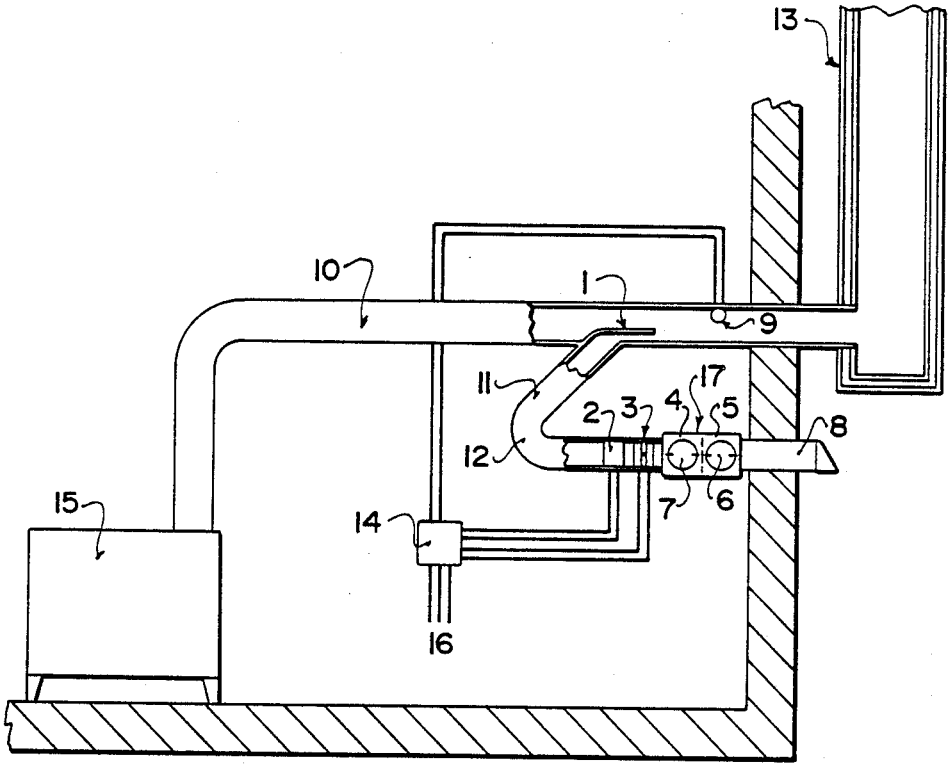
FIG. 4 is schematic illustration partly in cross-section and partly in elevation of the whole combustion apparatus including the attachment of FIG. 1.

Turning firstly to FIGS. 1 and 4, a conventional combustion device preferably a woodstove indicated at 15 and is connected to a flue duct 10 which communicates combustion gases from the combustion device 15 through an exterior wall of the building to a vertical flue stack 13 on the exterior of the building. This construction is strictly conventional and generally combustion in the combustion device 15 is sufficient to generate an updraft through the flue so that the combustion gases are drawn away from the combustion device to sustain combustion and to ensure that no combustion products escape into the building.

However in situations where the interior pressure of the building drops or the combustion is insufficient to maintain heat in the flue gases at a sufficient level to maintain the upwardly moving column of the gases in the stack 13, the flow can reverse. As soon as the column of air in the stack 13 becomes a column of cold air this will immediately overcome any remaining upward pressure and will cause the air to flow downwardly into the building ejecting the combustion products from the combustion device through the normal air intake openings.

The device according to the invention therefore includes a sensor 9 which comprises a conventional thermocouple for detecting the temperature of the air within the duct 10. The thermo couple can be adjusted to set the temperature at a position which is determined by simple experimentation. The sensor 9 is therefore responsive to the back draft actually commencing or to a preliminary stage at which is determined by experimentation that the back draft will shortly commence. The sensor 9 communicates with a control unit 14 which is supplied with power from a conventional 110 vac service indicated at 16.

In order to prevent the back draft commencing or to restore a forward draft condition shortly after the back draft has commenced, there is provided an air injection system. The air injection system comprises a duct 11 which connects to a nozzle or venturi device 1 mounted within the duct 10 of the flue. The duct 11 connects to an elbow 12 and to a horizontal portion of pipe which is generally located in the basement of the building in which the combustion device 15 is located. The horizontal pipe includes heater 2 which in one example can be a 1,000 w electric heater of a type which can be simply mounted in the duct or can include a separate housing communicating with a part of the duct. Upstream of the heater 2 is provided a fan schematically indicated at 3 which acts to drive air through the duct into the nozzle 1. Upstream of the fan 3 is provided an inlet air regulator generally indicated at 17. This allows inlet air into the duct to be driven by the fan through the nozzle 1.

Figure 2:
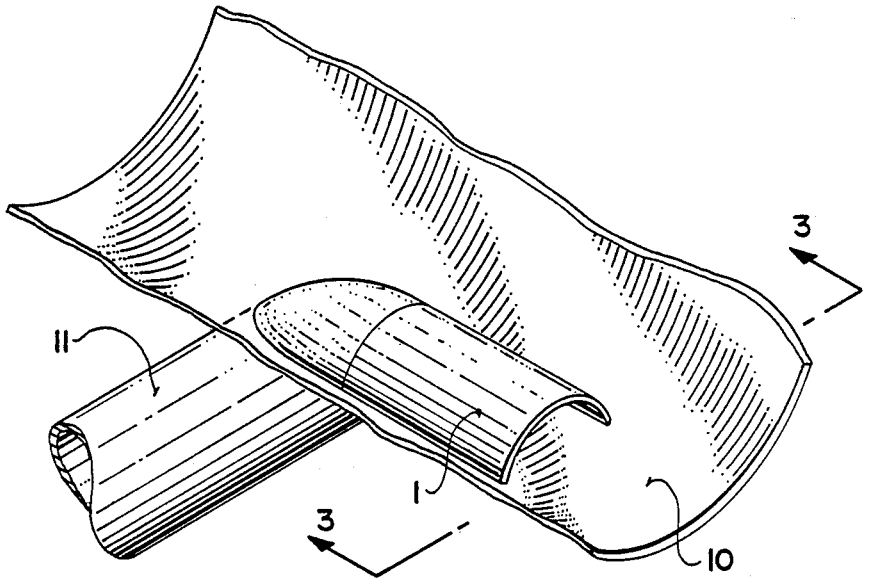
FIG. 2 is an isometric view on an enlarged scale of the nozzle by which the air is injected into the flue.
Figure 3:
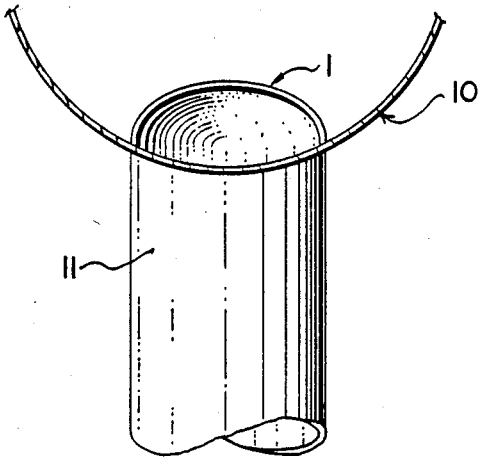
FIG. 3 is a cross-sectional view of the nozzle of FIG. 2.

The nozzle is shown in more detail in FIGS. 2 and 3. From these figures it will be seen that the duct portion 10 is circular in cross-section with only the lower wall portion being illustrated.

The nozzle 1 comprises an arched wall extending over a bottommost portion of duct 10 and defining therewith a duct portion longitudinal of the duct 10 and directed toward the stack 13. The nozzle or venturi air director 1 is connected to the duct part 11 which extends through an opening in the wall of the duct 10.

Figure 5:
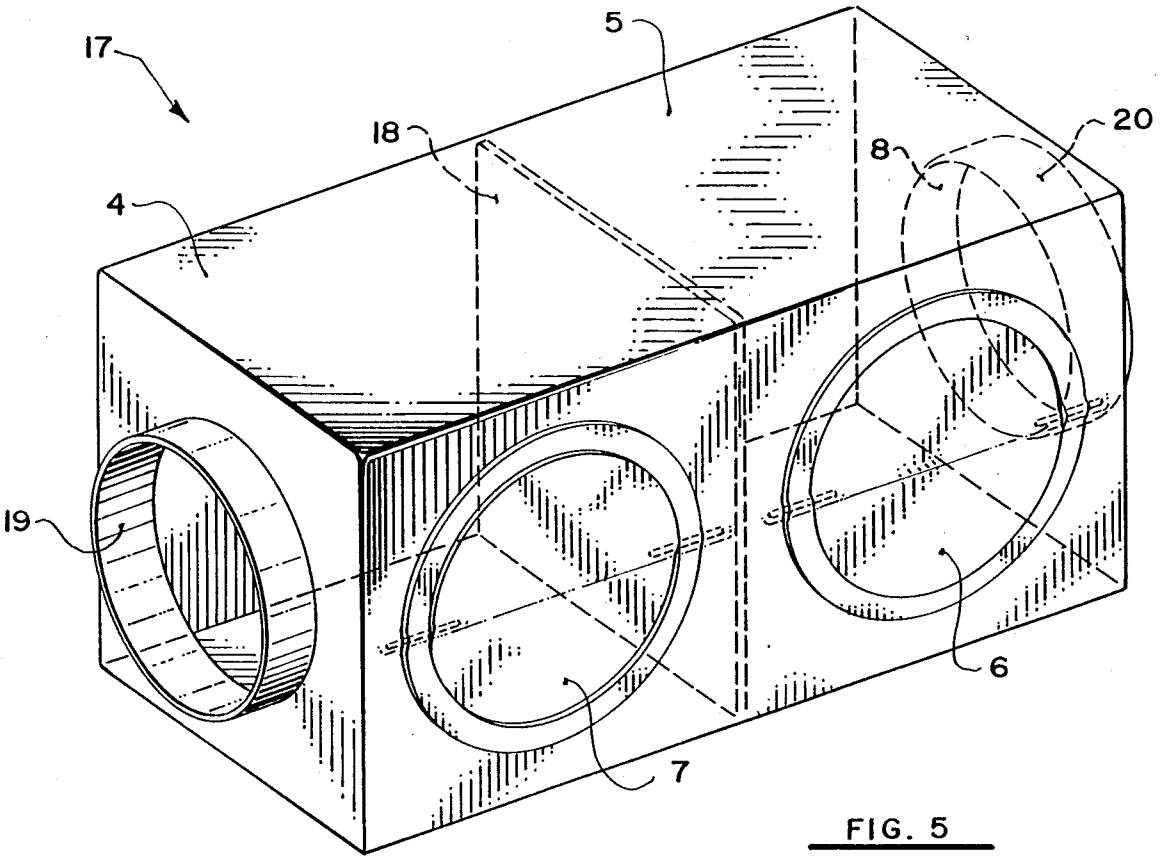
FIG. 5 is an isometric view of the inlet control device shown schematically in FIGS. 1 and 4.

The flow control unit 17 is shown in more detail in FIG. 5. The device comprises a housing which is rectangular in shape and is divided by a central wall 18 into two separate housing parts 4 and 5. One end wall of the part 4 includes a collar 19 for attachment to the duct upstream of the fan 3. The opposed end of the housing includes a collar 20 for attachment to an outside air connector 8 which projects through the outside wall of the building and includes a hood on the outside to allow the ingress of air from the exterior of the building.

A front wall of the housing is divided by the separator 18 into two parts. Each of the parts has an opening provided therein of a size approximately equal to that of the collars 20 to allow air flow which is substantially unrestricted. A conventional flap valve 6, 7 is provided in the opening to control flow of air through the opening. The flap valve 6 is arranged to allow freely air to flow from the exterior of the building into the interior of the building but to prevent air flow in the reverse direction. The flap valve 7 is arranged to allow flow of air from the interior of the building into the duct to feed the fan 3.

In operation, on detection of a back draft condition by the sensor 9, the control unit 14 actuates both fan and the heater to inject air through the nozzle into the flue. The air is injected in the direction longitudinal and forwardly of the flue so as to tend to generate a flow in the forward direction. In addition the air is heated so that the forwardly moving air also generates convection currents when that forwardly moving hot air reaches the stack 13.

The operation of the fan and the heater can be terminated either by detecting a rise in the temperature in the flue to a predetermined higher temperature, or by a timer. Thus, when the back draft condition is removed, the injection system is halted to allow the normal combustion process to continue.

The air feeding the fan 3 is pulled into the flow control unit 17 through the opening in the front wall as controlled by the flap valve 7. If the air pressure in the interior of the building is sufficient, the air is drawn from the interior of the building and directed to the flue. If the air pressure in the building has fallen, air is drawn into the interior through the outside duct 8 and via the flap valve 6. As the openings in the front face are arranged closely adjacent, when exterior air is drawn into the building for supply to the flue, that exterior air passes substantially directly from the opening in the front face connecting with the outside duct 8 to the opening in the front face connecting to the fan. Thus little cold draft is generated in the area of the flow control device 17.

However it will be appreciated that the valves 6 and 7 can operate independently. If there is no need for the valve 6 to open, air is drawn into the unit from the interior of the building and this can act to reduce concentrations of noxious or dangerous gases in the basement area, for example, radon. When the fan 3 is not operating, the flap valve 6 can control ventilation into the basement to maintain the pressure within the building substantially at atmospheric pressure and this by itself will to some extent reduce the likelihood of the back draft condition developing.

Since various modifications can be made in my invention as hereinabove described, and many apparently widely different embodiments of same made within the spirit and scope of the claims without departing from such spirit and scope. It is intended that all matter contained in the accompanying specification shall be interpreted as illustrative only and not in a limiting sense.

I claim:

1. A combustion and flue device comprising a combustion device mounted within the interior of a building, a flue leading from the combustion device and including at least a part thereof which rises to an outlet communicating with the exterior of the building at a height above the combustion device and arranged such that heat in the combustion gases generated by the combustion device is, at least part of the time, sufficient to generate a forward flow of the gases in the flue from the combustion device to the outlet, a nozzle in the flue arranged to inject gases into the flue in a forward direction to tend to induce flow of the gases in the flue in the forward direction, a duct communicating from an inlet means to the nozzle, fan means in the duct for generating a flow of gases from the inlet means to the nozzle, heating means in a duct for heating the gas as it travels from the inlet means to the nozzle, and means responsive to a back draft condition in the flue to actuate said fan means and said heating means.

2. The invention according to claim 1 wherein the inlet means is separate from the flue so that the gases drawn into the duct comprise fresh air.

3. The invention according to claim 1 wherein the means responsive to a back draft condition comprises a temperature sensor arranged to detect a temperature of the flue gases less than that necessary to generate said forward flow of the gases in the flue.

4. The invention according to claim 1 wherein the nozzle comprises a duct portion extending in a direction along the flue and having one side wall of the duct portion defined by a portion of the wall of the flue, the duct portion having an open mouth at an end thereof facing toward the outlet of the flue, said duct communicating with said duct portion.

5. The invention according to claim 1 wherein the inlet means comprises a flow control member having a first opening connecting from the interior of the building into said duct, a first flap valve mounted in the first opening and arranged to allow air to flow through the first opening into said duct from the interior of the building and to prevent air from flowing to the duct into the interior of the building, a second opening connecting from the interior of the building to a duct member connected to the exterior of the building, second flap valve mounted in the second opening allowing air to flow from the exterior of the building to the interior of the building and preventing air from flowing from the interior of the building to the exterior of the building to the exterior of the building, said first and second openings being mounted such that air entering the interior of the building through the second opening can flow substantially directly into the first opening for flowing along the duct.

6. The invention according to claim 5 wherein the flow control member comprises a housing, means dividing the housing into a first housing part and a second housing part, means connecting the first housing part to the duct, means connecting the second housing part to the duct member connected to the exterior of the building, the housing having a housing wall including a part defining a face of the first housing part and a part defining a face of the second housing part, a first opening being mounted in the first housing wall part and the second opening being mounted in the second housing wall part.

7. The invention according to claim 1 wherein the combustion device comprises a wood burning stove.

8. A combustion and flue device comprising a combustion device mounted within the interior of a building, a flue leading from the combustion device and including at least a part thereof which rises to an outlet communicating with the exterior of the building at a height above the combustion device and arranged such that heat in the combustion gases generated by the combustion device is, at least part of the time, sufficient to generate a forward flow of the gases in the flue from the combustion device to the outlet, a nozzle in the flue arranged to inject gases into the flue in a forward direction to tend to induce flow of the gases in the flue in the forward direction, air inlet means and a duct communicating from said inlet mean to the nozzle, wherein the inlet means comprises a flow control member having a first opening connecting from the interior of the building into said duct, a first flap valve mounted in the first opening and arranged to allow air to flow through the first opening into said duct from the interior of the building and to prevent air from flowing to the duct into the interior of the building, a second opening connecting from the interior of the building to a duct member connected to the exterior of the building, second flap valve mounted in the second opening allowing air to flow from the exterior of the building to the interior of the building and preventing air from flowing from the interior of the building to the exterior of the building to the exterior of the exterior of the building, said first and second openings being mounted such that air entering the interior of the building through the second opening can flow substantially directly into the first opening for flowing along the duct.

9. The invention according to claim 8 wherein the flow control member comprises a housing, means dividing the housing into a first housing part and a second housing part, means connecting the first housing part to the duct, means connecting the second housing part to the duct member connected to the exterior of the building, the housing having a housing wall including a part defining a face of the first housing part and a part defining a face of the second housing part, the first opening being mounted in the first housing wall part and the second opening being mounted in the second housing wall part.

10. An anti back draft device for the flue of a combustion device of the type which is mounted within the interior of a building and includes a flue leading from the combustion device and having at least a part thereof which rises to an outlet communicating with the exterior of the building at a height above the combustion device and arranged such that heat in the combustion gases generated by the combustion device is, at least part of the time, sufficient to generate a forward flow of the gases in the flue from the combustion device to the outlet, the anti back draft device comprising nozzle means for mounting in the flue arranged to inject gases into the flue in a forward direction to tend to induce flow of the gases in the flue in the forward direction, a duct communicating from an inlet means to the nozzle, fan means in the duct for generating a flow of gases from the inlet means to the nozzle, heating means in a duct for heating the gas as it travels from the inlet means to the nozzle, and means responsive to a back draft condition in the flue to actuate said fan means and said heating means.

11. The invention according to claim 10 wherein the inlet means is separate from the flue so that the gases drawn into the duct comprise fresh air.

12. The invention according to claim 10 wherein the means responsive to a back draft condition comprises a temperature sensor arranged to detect a temperature of the flue gases less than that necessary to generate said forward flow of the gases in the flue.

13. The invention according to claim 10 wherein the nozzle means comprises a duct portion extending in a direction along the flue and having one side wall of the duct portion defined by a portion of the wall of the flue, the duct portion having an open mouth at an end thereof facing toward the outlet of the flue, said duct communicating with said duct portion.

14. The invention according to claim 10 wherein the inlet means comprises a flow control member having a first opening connecting from the interior of the building into said duct, a first flap valve mounted in the first opening and arranged to allow air to flow through the first opening into said duct from the interior of the building and to prevent air from flowing to the duct into the interior of the building, a second opening connecting from the interior of the building to a duct member connected to the exterior of the building, second flap valve mounted in the second opening allowing air to flow from the exterior of the building to the interior of the building and preventing air from flowing from the interior of the building to the exterior of the building to the exterior of the building, said first and second openings being mounted such that air entering the interior of the building through the second opening can flow substantially directly into the first opening for flowing along the duct.

15. The invention according to claim 14 wherein the flow control member comprises a housing, means dividing the housing into a first housing part and a second housing part, means connecting the first housing part to the duct, means connecting the second housing part to the duct member connected to the exterior of the building, the housing having a housing wall including a part defining a face of the first housing part and a part defining a face of the second housing part, a first opening being mounted in the first housing wall part and the second opening being mounted in the second housing wall part.

* * * * *